US007178868B2

(12) United States Patent
Richardson et al.

(10) Patent No.: US 7,178,868 B2
(45) Date of Patent: Feb. 20, 2007

(54) GARDENING CHAIR

(76) Inventors: Charlene F. Richardson, 4803 Neil St., Alexandria, LA (US) 71302; Michael A. Richardson, 4803 Neil St., Alexandria, LA (US) 71302; Glenn A. Stewart, 2308 Broadway Ave., Alexandria, LA (US) 71302

( * ) Notice: Subject to any disclaimer, the term of this patent is extended or adjusted under 35 U.S.C. 154(b) by 0 days.

(21) Appl. No.: 10/434,705

(22) Filed: May 9, 2003

(65) Prior Publication Data

US 2005/0264050 A1 Dec. 1, 2005

(51) Int. Cl.
*B60N 2/24* (2006.01)

(52) U.S. Cl. ..... 297/195.11

(58) Field of Classification Search ..... 297/195.11, 297/452.18, 445.1, 447.4, 344.18, 354.1, 297/361.1, 354.13, 452.48, 452.58, 452.59, 297/452.62, 423.11

See application file for complete search history.

(56) References Cited

U.S. PATENT DOCUMENTS 1,932,794 A * 10/1933 McArthur, Jr. ..... 297/411.44
3,544,161 A * 12/1970 Bryden ..... 297/391
3,822,424 A * 7/1974 Messer ..... 5/419
4,098,478 A * 7/1978 Spitzke ..... 248/156
4,302,048 A * 11/1981 Yount ..... 297/440.1
4,512,047 A * 4/1985 Johnson ..... 297/452.48
4,588,227 A * 5/1986 Austin ..... 297/440.24
5,556,157 A * 9/1996 Wempe ..... 297/68
5,720,522 A * 2/1998 Habeck ..... 297/337
5,868,461 A * 2/1999 Brotherston ..... 297/84
5,882,083 A * 3/1999 Robinson ..... 297/440.2
5,911,478 A * 6/1999 Goodman ..... 297/440.11
6,065,808 A * 5/2000 Tinsley ..... 297/423.11
6,095,607 A * 8/2000 Wenzel ..... 297/344.18
6,158,810 A * 12/2000 Galloway ..... 297/354.1
6,224,156 B1 * 5/2001 Fleigle ..... 297/354.1
6,499,163 B1 * 12/2002 Stensby ..... 5/618
6,540,301 B1 * 4/2003 Bottoms ..... 297/423.11
6,543,844 B1 * 4/2003 Ryan et al. ..... 297/219.12
6,595,589 B2 * 7/2003 Cochran ..... 297/423.11
6,595,590 B2 * 7/2003 Bottoms ..... 297/423.11

FOREIGN PATENT DOCUMENTS

DE 3201462 A1 * 7/1983

* cited by examiner

*Primary Examiner*—Milton Nelson, Jr.
(74) *Attorney, Agent, or Firm*—Kenneth D. Baugh

(57) ABSTRACT

A gardening chair 10 is provided for supporting a user 12 thereon. The gardening chair 10 is provided with a base support member 14, and a seat 52 aligned with and coupled to upper portions of the base support member for supporting a user's lower body thereon. A diagonally extending chest support member 72 is provided for supporting a user's chest 12 and upper body thereon. A pair of elongated upwardly biasing members 86 and 88 are coupled between the diagonally extending chest support member 72 and the base support member 14 to support the member for movement to a plurality of predetermined diagonal positions.

8 Claims, 5 Drawing Sheets

GARDENING CHAIR

TECHNICAL FIELD

This invention relates to a chair and more particularly to a chair to be used in gardening. For some time now gardening has been a very popular activity. The practicality of gardening activities is increasingly becoming part of the hobbies and leisure activities of an ever increasing number of people. Although these activities are popular they can be somewhat tedious particularly such essential parts of the gardening process as weed removal and planting. Removal of weeds of course improves the appearance of a garden or landscaped area and of course eliminates those nuisance plants that tend to destroy the valuable plants that are planted to grow in the same ground. The most effective method of weeding and planting an area is of course by hand. Normally however this can take a significant amount of time, in somewhat awkward work positions that place a great deal of physical strain on many parts of the body. Accordingly it is desirable to provide an apparatus that can minimize the physical strain associated with the weeding and planting process so that a more comfortable and enjoyable physical experience is achievable.

BACKGROUND OF THE ART

Attempts have been made to provide garden chairs that are desirable which can also satisfy the users need for comfort while outdoors. One such chair is disclosed in U.S. Pat. No. 4,556,224. This chair is a garden chair including a back rest, a seat and a cross frame defined by a first and second pair of support braces rotatably connected together through a first axle. The first pair of support braces are also rotatably connected to the front of the seat through a second axle and the rear of the seat is rotatably connected to the back rest through a third axle. An arm provided with a longitudinal slot connects the second pair of braces to the back rest, with the third axle passing through the longitudinal slot. A free end of the arm and the back rest are engabable in a plurality of positions to permit vertical adjustment of the seat.

Another arrangement is disclosed in U.S. Pat. No. 5,397,168. This seating apparatus includes a frame, a member supported by the frame for movement relative thereto, a ratchet mechanism for affording movement of the member relative to the frame in a first direction from a first extreme position through a range of positions to a second extreme position and for preventing movement of the member relative to the frame in a second direction opposite to the first direction. The ratchet mechanism includes a ratchet and a one-piece pawl including a first portion engageble with the ratchet, a resilient portion for bracing the pawl into engagement with the ratchet, and a release mechanism for completely disengaging the ratchet and the pawl when the member is moved into the second extreme position.

These arrangements are suitable for the purpose intended. That is to provide a suitable adjustable seat to be used outdoors. However these seats are designed to provide comfort for a user while engaged in leisurely and restful activities. They are not designed for and cannot be readily useable in a working environment such as for gardening. They do not provide structures that will ease the physical strain on the body while engaged in gardening activities. Such a gardening chair is desirable.

DISCLOSURE OF THE INVENTION

A gardening chair for supporting a user thereon in accordance with the principles of this invention is provided with a base support member, and a seating means aligned with and coupled to upper portions of the base support member for supporting a user's lower body thereon. A diagonally extending support member is provided for supporting a user's chest and upper body thereon. A means for supporting the diagonally extending support member for movement to a plurality of predetermined diagonal positions is coupled between the diagonally extending support member and the base support member. The gardening chair is further provided with a means for stopping the diagonally extending supporting member in a predetermined lowermost diagonal position.

BRIEF DESCRIPTION OF THE INVENTION

The details of the invention will be described in connection with the accompanying drawing in which.

BEST MODE FOR CARRYING OUT THE INVENTION

Figure 1:
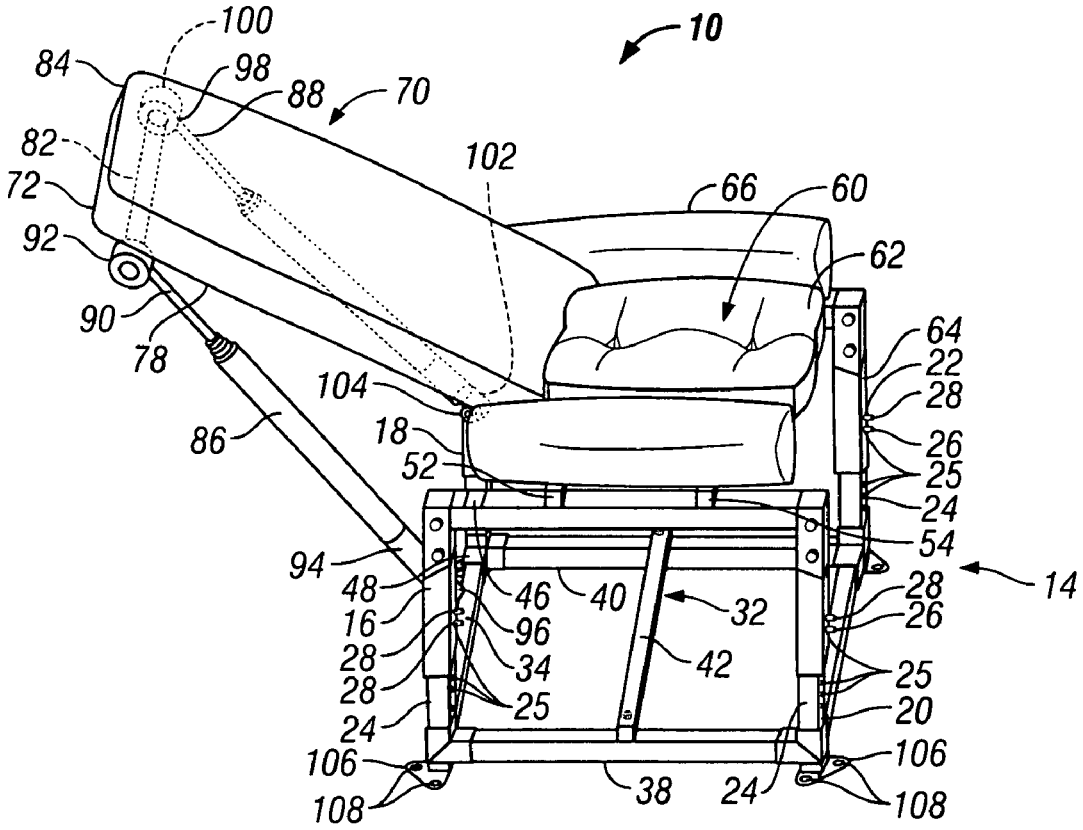
FIG. 1 is a perspective view illustrating a gardening chair in accordance with the principles of the invention.
Figure 2:
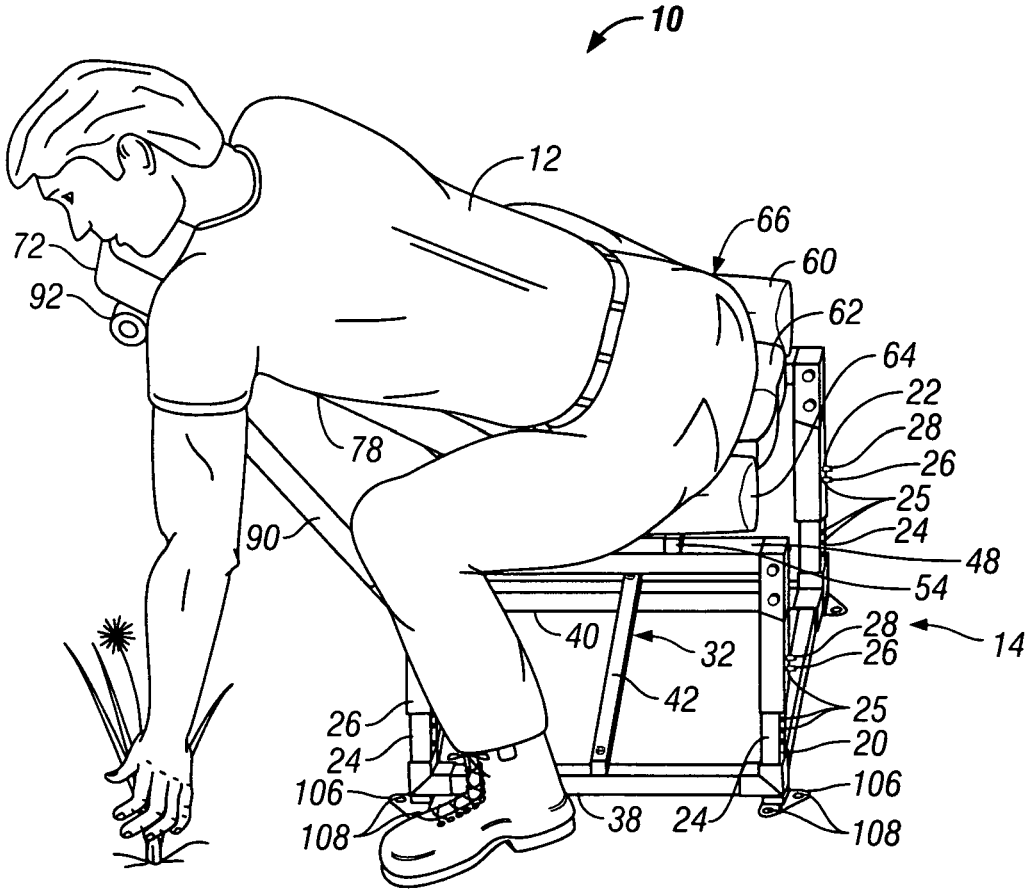
FIG. 2 is another perspective view illustrating a gardening chair with a user resting thereon in accordance with the principles of the invention.
Figure 3:
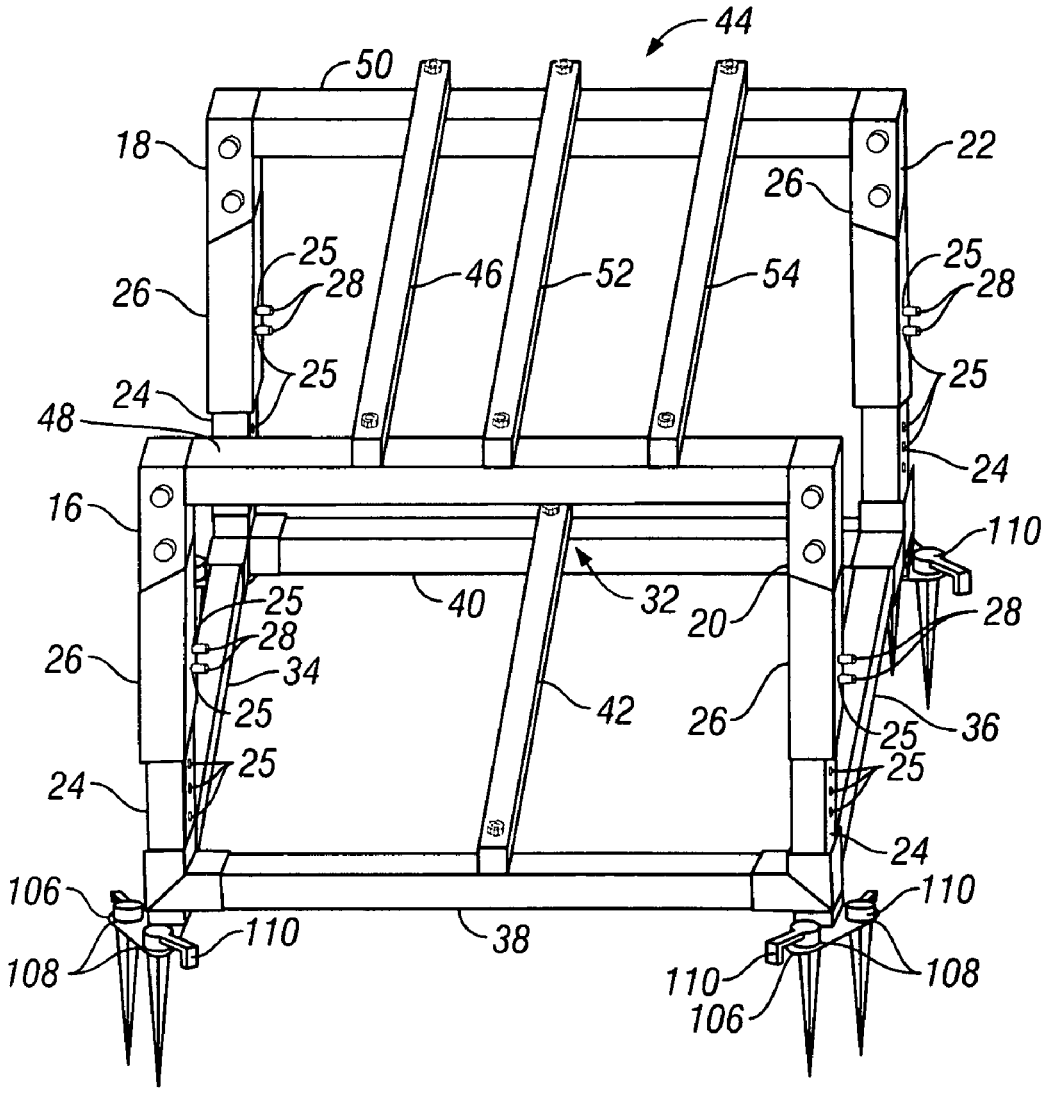
FIG. 3 is perspective view illustrating portions of a base support member of the gardening chair in accordance with the principles of the invention.

Referring to FIGS. 1, 2 and 3 a gardening chair, generally designated by the numeral, 10 is provided to support a user 12 (FIG. 2) thereon while engaged in gardening activities. The chair 10 includes a base support member, generally designated, by the numeral 14.

The base support member 14 is provided with a pair of spaced front vertically extending legs 16 and 18, and a pair of spaced vertically extending rear legs 20 and 22. The vertically extending legs 16, 18, 20 and 22 are each provided with a lower member 24 and upper member 26. The lower member 24 is mounted for slidable movement inside the upper member 26. The lower member 24 and the upper member 26 are both provided with adjacently alignable apertures 28 formed therein and pins 30 which are provided to rest in the aligned apertures 28 in the upper and lower members 24 and 26. This allows the legs 16, 18 20 and 22 to be lengthened or shortened in a well known manner as may be desired by a user. This may become desirable because of the irregularity of the terrain or even the size of the plants or weeds in a gardening work area. A rectangular shaped lower support member, generally designated, by the numeral 32 is provided to stabilize lower portions of the base support member 14. The lower support member 32 is provided with horizontally extending support members 34,36, 38 and 40. The members 34, 36 38 and 40 couple the legs 16, 18, 20 and 22 together in a rectangular configuration. The front legs 16 and 18 are coupled to each other by the horizontally extending support member 34 at lowermost portions thereof The rear legs 20 and 22 are coupled together at a lowermost portion thereof by the horizontally extending member 36. The front leg 16 and the rear leg 20 are coupled together at lowermost portions thereof by the horizontally extending member 38 and the front leg 18 and the rear leg 22 are coupled together by the horizontally extending member 40. The lower support member 32 of the base support member 14 is also provided with an intermediate horizontally extending support member 42 which is coupled between intermediate portions of the horizontally extending members 38 and 40.

The base support member 14 is also provided with an upper support member, generally designated, by the numeral 44. The upper support member is provided with horizontally extending members 46, 48 and 50 (FIG. 3). The horizontally extending support member 46 of the upper support member is coupled between the front legs 16 and 18 at uppermost portions thereof. The horizontally extending member 48 couples the front leg 16 and rear leg 20 together at uppermost portions thereof and the front leg 18 and rear leg 22 are coupled together at uppermost portions thereof by the horizontally extending member 50.

The base support member 14 is also provided with a pair of adjacently aligned spaced horizontally extending seat support members 52 and 54 which are coupled between the horizontally extending members 48 and 50 at intermediate portions thereof The chair 10 is also provided with a seating apparatus, generally designated, by the numeral 60. The seating apparatus 60 is provided with a center rectangle shaped padded seating member 62 and a pair of adjacently aligned elongated shaped padded seating members 64 and 66. The center seating member 62 of the seating apparatus 60 is supported and coupled to the horizontally extending seat support members 52 and 54 on the upper support member 44 of the base support member 14. The elongated padded seating members 64 and 66 are adjacently aligned on opposite sides of the center seating member 62 above one of the horizontally extending members 48 and 50 respectively.

The chair 10 is also provided with a chest support member, generally designated, by the numeral 70. The chest support member 70 provides support to the chest of a user 12 of the chair 10.

The chest cushion 72 is also provided with a support bracket 82 which is coupled to an upper portion 84 of the under side 78 thereof The chest support member 70 is also provided with a pair of diagonally extending elongated biasing members 86 and 88. The elongated members provided an upward biasing tension on the chest cushion 72 which allows it to be maintained in predetermined desired diagonal positions. The elongated member 86 is coupled at one end 90 thereof to one side of the upper support bracket 82 of the chest cushion 72 by a coupling member 92 and the other end 94 thereof to the front leg 16 of the base support member 14 by a coupling member 96. The other elongated member 88 is coupled at an end 98 thereof to the other side of the support bracket 82 by a coupling member 100 and at the other end 102 thereof to the front leg 18 of the base support member 14 by a coupling member 104. The elongated biasing members 84 and 86 determine the degree of incline of the chest cushion 72 and allows a user to move downwardly to rest in a predetermined diagonal position over a designated work area while also helping the user to move upwardly by a gentle push in that direction. The elongated biasing members in this embodiment may be for example, gas struts or shock absorbers.

The chair 10 is also provided with triangular shaped support members 106 which are coupled to the bottom of each one of the legs 16, 18, 20 and 22 of the base support member 14. The triangular shaped support members 106 are provided with a plurality of apertures 108. The apertures 108 are provided to receive a ground engaging spike 110 which when inserted through the aperture into the ground locks the chair in place to the ground.

When in use the user 12 of the chair 10 is seated thereon so the chest of the user engages the cushion in a manner so the arms and hand of the user hang over the cushion and can move freely to function in the work area. This gives the user 12 support to the chest, shoulders and neck while being in a forward inclined position thereby taking the stress and strain off the lower back normally caused from having to lift up and down while gardening.

Figure 4:
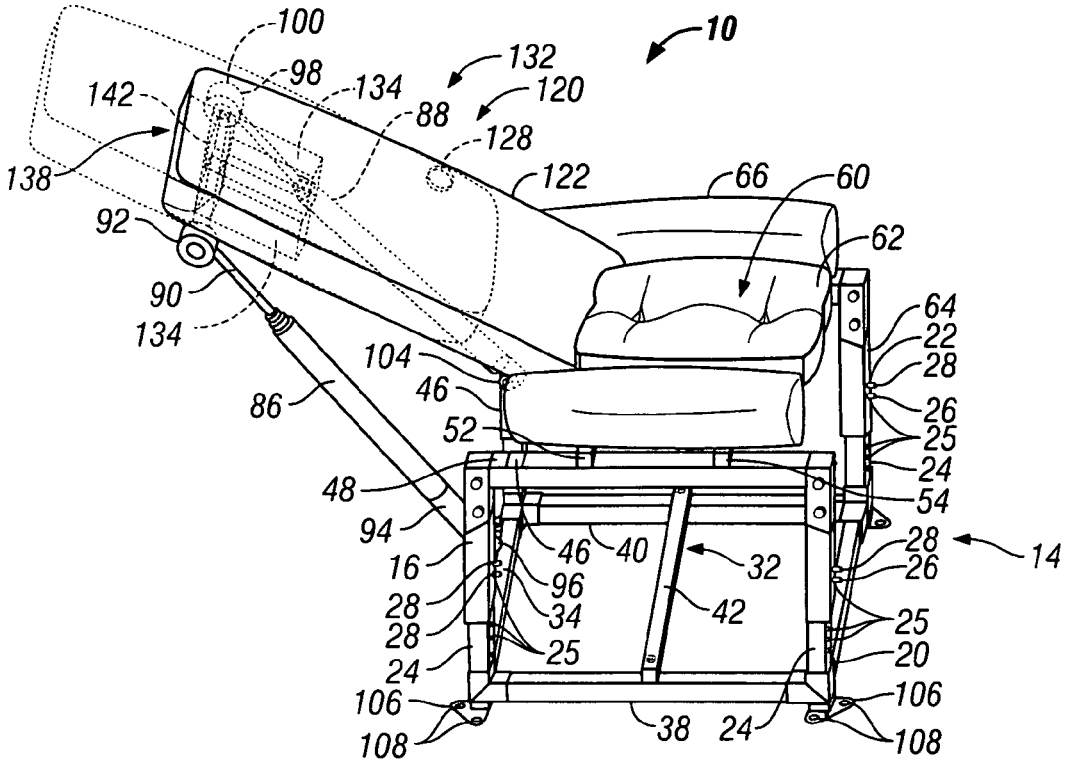
FIG. 4 is a perspective view illustrating a second embodiment of a gardening chair in accordance with the principles of the invention.
Figure 5:
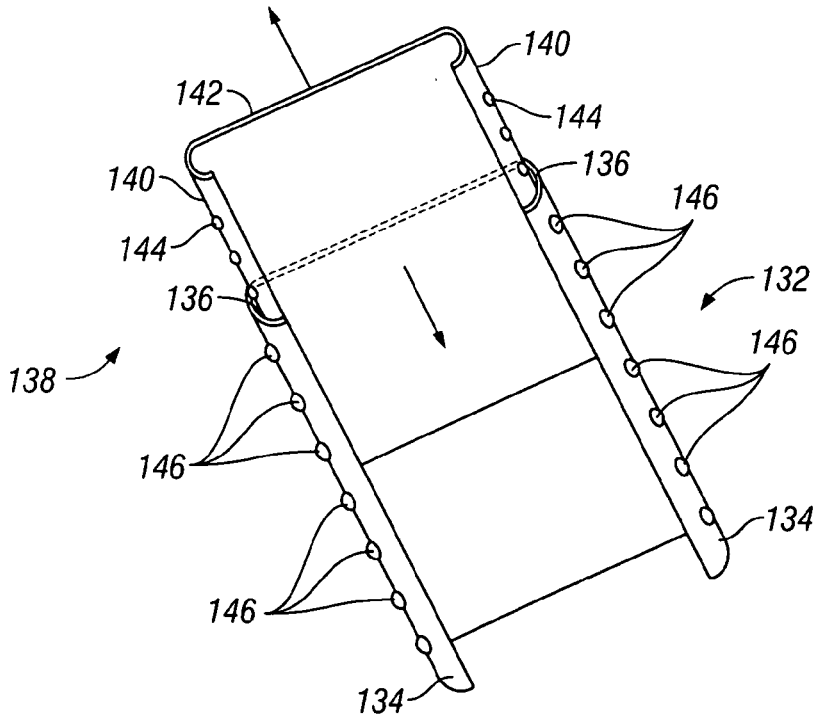
FIG. 5 is a detail view of the adjustable chest support member of the gardening chair in accordance with the principles of the invention.

A second embodiment of the chair 10 is illustrated in FIGS. 4 and 5. The chair 10 in this embodiment includes an adjustable chest support member, generally designated, by the numeral 120. The chest support member 120 can be adjusted to support and accommodate the chest length of different users 12 of the chair 10. The chest support member 120 is provided with a planar shaped chest cushion 122.

The chest cushion 122 is also provided, with a support bracket, generally designated, by the numeral 132 which is coupled to the under side 128 thereof. The support bracket 132 is provided with a pair of spaced elongated track members 134. Each track member 134 is provided with a longitudinally extending opening 136 formed therethrough and a plurality of spaced aligned grooves formed therein. The support bracket 132 is also provided with a movable support member, generally designated, by the numeral 138. The support member 138 is provided with a pair of spaced elongated members 140 and a horizontally extending upper support member 142 coupled to uppermost portions of the elongated members. Each one of the pair of elongated members 140 is provided with a plurality of spaced aligned abutments 144 formed thereon. The plurality of spaced aligned abutments 144 are aligned to be engaged with grooves 146 formed in the elongated members 140 of support member 138 to lock the chest cushion in place to support the chest of the user. Additionally, each one of the elongated members 140 is aligned with and coupled for slidable movement in a corresponding opening 136 of one of the track members 134.

In this embodiment the elongated member 86 is coupled at one end 90 thereof to one side of the upper support member 142 of the chest cushion 122 by a coupling member 92 and the other end 94 thereof to the front leg member 16 of the base support member 14 by a coupling member 96. The other elongated member 88 is coupled at an end 98 thereof to the other side of the upper support member 142 by a coupling member 100 and at the other end 102 thereof to the front leg member 18 of the base support member 14 by a coupling member 104.

When is it desired to adjust the length of the chest cushion 122 the cushion is moved either up or down as illustrated by the arrows. When the cushion 122 is moved the elongated members 140 slide in the tracks 134 of the bracket 132 and is held in place as the abutments 144 of elongated members engage corresponding grooves 146 in the tracks 134. This allows the chest cushion to be adjusted as needed while the elongated biasing members 84 and 86 determine the degree of incline of the chest cushion to allow a user to lean over a designated work area.

Figure 6:
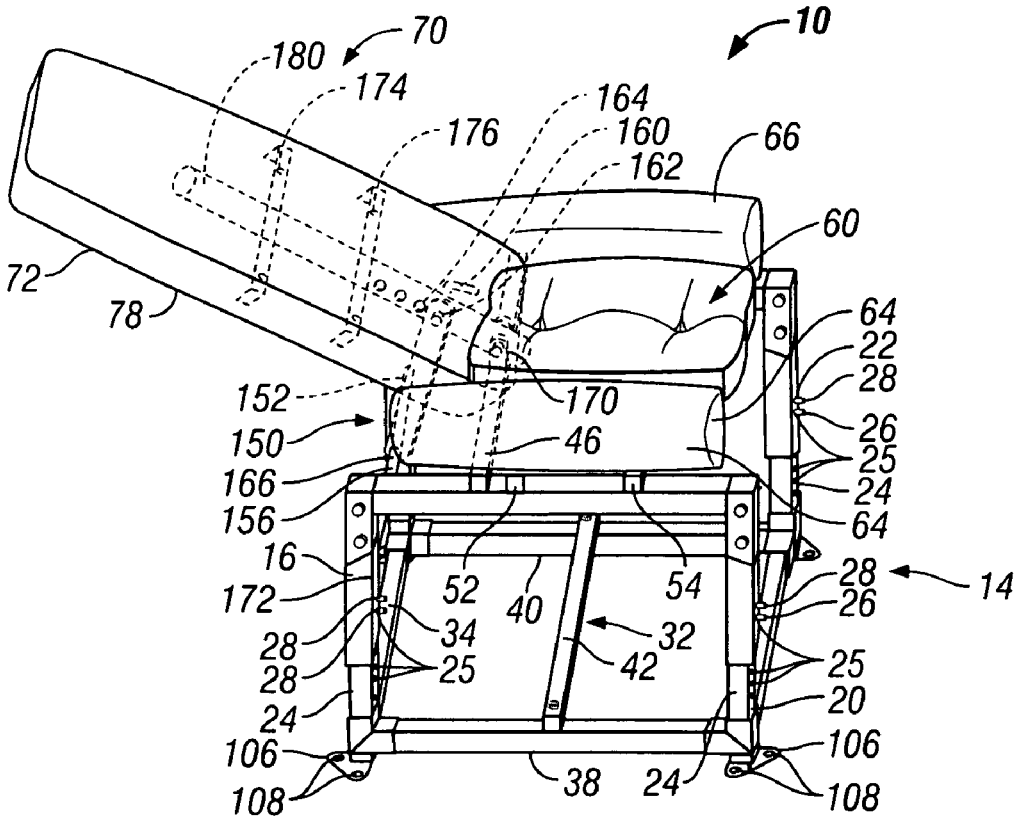
FIG. 6 is a perspective view of a third embodiment of a gardening chair in accordance with the principles of the invention.

A third embodiment of the chair 10 is illustrated in FIG. 6. In this embodiment the chest support member 70 is provided with an elastic resistance apparatus, generally designated, by the numeral 150. The elastic resistance apparatus 150 provides an upward biased tension on the chest cushion 72 which allows it to be maintained in predetermined desired diagonal positions.

The apparatus 150 is provided with an L-shaped tensioning arm 152, and an elastic band 156. The tensioning arm 152 is coupled at one end 160 thereof to an intermediate portion of a lower portion 162 of chest cushion 72 by a coupling member 164. Another end 166 of the tensioning arm which is supported under the seat is coupled to one end 168 of the elastic band 156 by a coupling member 170. The elastic band 156 is then coupled at an end 172 to an intermediate portion of the horizontally extending bar 34 which extends between the fronts leg 16 and 18 of the base support member 14. The elastic resistance support apparatus 150 determines the degree of incline of the chest cushion 72 to allow a user to lean over a designated work area while also helping to assist a user to move downwardly by the user's weight on the cushion 72 and move upward by a gentle push upward to straighten up. The elastic support apparatus may also for example be configured with a pair of tensioning arms and elastic bands if more support is desirable. The chest cushion 72 is provided with a pair of support brackets 174 and 176 (shown in dotted lines) which are mounted to intermediate portions of an under side 78 of the cushion 72. The chest support member 70 is also provided with an elongated support member 180 which is coupled to the brackets 174 and 176. The elongated support member 180 is provided to engage the horizontally extending member 46 on the upper support member 44 to keep the chest cushion 72 from being moved downwardly beyond a predetermined diagonal position.

It should be understood that the invention described herein can be used in other work environments without departing from the spirit of the invention as defined in the claim.

It should be further understood that various changes and modifications can be made without departing from the spirit of the invention as defined in the claim.

What is claimed is:

1. A gardening chair for supporting a user thereon including:

a base support member including a first pair of spaced vertically extending leg members, a second pair of vertically extending leg members spaced from and aligned with the first pair of vertically extending leg members, an upper support member having a first horizontally extending member coupled between the first pair of vertically extending leg members, a second horizontally extending member coupled between a first one of the first pair of vertically extending leg members and a first one of the second pair of vertically extending leg members, a third horizontally extending member coupled between a second one of the first pair of vertically extending leg members and a second one of the second pair of vertically extending leg members, a pair of spaced horizontally extending members coupled between the second and third horizontally extending members at intermediate portions thereof, and a lower support member aligned with and coupled to lowermost portions of the first and second pair of vertically extending leg members;

a seating means aligned with and coupled to upper portions of the base support member for supporting a user's lower body thereon;

a diagonally extending support member, including an elongated planar shaped member, for supporting a user's chest and upper body thereon;

means for facilitating movement of the elongated planar shaped member upwardly and downwardly to accommodate different chest length of users; and means coupled to the diagonally extending support member and the base support member for supporting the diagonally extending support member for movement to a plurality of predetermined diagonal positions.

2. A gardening chair as defined in claim 1 wherein the lower support member further includes:

a fourth horizontally extending member coupled between the first pair of leg members a fifth horizontally extending member coupled between the second pair of leg members;

a sixth horizontally extending member coupled between the first one of the first pair of leg members and the first one of the second pair of leg members;

a seventh horizontally extending member coupled between the second one of the first pair of leg members and the second one of the second pair of leg members; and an eighth horizontally extending member coupled between the sixth and seventh horizontally extending members at intermediate portions thereof.

3. A gardening chair as defined in claim 2 wherein the seating means includes:

a rectangular shaped padded member aligned with and coupled to the pair of spaced horizontally extending members of the upper support member;

a first elongated padded member adjacently aligned with the rectangular shaped padded member on one side thereof above the second horizontally extending member of the upper support member; and a second elongated padded member adjacently aligned the rectangular shaped padded member on the other side above a the third horizontally extending member of the upper support member.

4. A gardening chair as defined in claim 3 wherein the means for supporting the diagonally extending support member for movement to a plurality of predetermined positions includes:

a first upwardly biased elongated member having first portions thereof coupled to upper portions of one side of the elongated planar shaped member, and a second portion thereof coupled to the first leg member of the first pair of leg members; and a second upwardly biased elongated member having first portions thereof coupled to upper portions of another side of the elongated planar shaped member and second portions thereof coupled to the second leg member of the first pair of leg members.

5. A gardening chair as defined in claim 4 wherein each leg member of the first and second pair of leg members includes:

an upper member having apertures formed therein;

a lower member having apertures formed therein, slidably mounted in the upper member so that the apertures in the lower member are adjacently aligned with the apertures in the upper member; and a removable aperture engaging pin for insertion into adjacently aligned apertures in the upper and lower members so that the leg members can be lengthened or shortened.

6. A gardening chair as defined in claim 5 wherein each leg member of the first and second pair of leg members includes a means for coupling the leg member to a surface of a working area.

7. A gardening chair as defined in claim 6 wherein the surface coupling means includes:

a planar member having apertures formed therein coupled to a lowermost portion of the lower member of the leg member; and an engaging member insertable through the apertures in the planar member to engage the planar member and surface thereby securing the leg members to the surface.

8. A gardening chair as defined in claim 7 wherein the elongated member facilitating movement means includes:

a first elongated track member having a longitudinally extending opening formed therethrough and a plurality of spaced aligned grooves formed therein;

a second elongated track member spaced from and aligned with the first elongated track member having a longitudinally extending opening formed therethrough and a plurality of spaced aligned groves formed therein;

a first elongated member having a plurality of spaced aligned abutments formed thereon coupled for slidable movement in the opening in the first elongated track member;

a second elongated member having a plurality of spaced aligned abutments formed therein coupled for slidable movement in the opening in the second elongated track member; and a horizontally extending upper support member coupled to uppermost portions of the first and second elongated members.

* * * * *